United States Patent [19]

Stillings

[11] 4,203,561

[45] May 20, 1980

[54] YARN CUTTER

[76] Inventor: William G. Stillings, 1006 Keats Dr., Vallejo, Calif. 94590

[21] Appl. No.: 929,107

[22] Filed: Jul. 31, 1978

[51] Int. Cl.[2] ..... B65H 54/02; B65H 54/56

[52] U.S. Cl. ..... 242/47; 28/147; 30/124; 30/289; 242/48; 242/50; 242/53; 242/110.3

[58] Field of Search ..... 242/47, 48, 49, 50, 242/53, 1, 127, 129, 110.3, 96, 104, 106; 30/124, 289; 28/147

[56] References Cited

U.S. PATENT DOCUMENTS

| | | | |
|---|---|---|---|
| 28,297 | 5/1860 | Palmer | 242/110.3 |
| 329,752 | 11/1885 | Ludlow | 242/50 |
| 1,063,288 | 6/1913 | Rosenberg | 28/147 |
| 1,252,483 | 1/1918 | Pattison | 242/110.3 |
| 1,261,738 | 4/1919 | Palmer | 242/110.3 |
| 2,903,196 | 9/1959 | Fowler | 242/104 |
| 3,042,329 | 7/1962 | Signorella | 242/48 |
| 3,783,478 | 1/1974 | Osterhout | 28/147 |
| 3,857,143 | 12/1974 | Montory et al. | 30/124 X |
| 3,998,402 | 12/1976 | Christensen et al. | 242/106 |

FOREIGN PATENT DOCUMENTS

| | | | |
|---|---|---|---|
| 37838 | 9/1913 | Sweden | 242/47 |
| 187005 | 2/1937 | Switzerland | 242/110.3 |
| 329592 | 5/1930 | United Kingdom | 30/289 |
| 615465 | 1/1949 | United Kingdom | 242/110.3 |
| 621076 | 4/1949 | United Kingdom | 242/127 |

*Primary Examiner*—Stanley N. Gilreath
*Attorney, Agent, or Firm*—Jack C. Munro

[57] ABSTRACT

An apparatus for cutting a plurality of identical in length pieces of yarn which takes the form of a yarn holder which is rotatably mounted on a base and a pair of stanchions with a rotatable rod or spool supported therebetween. The stanchions are also supported on the base. Crank means is connected to one of the stanchions to cause rotation of the rod. The rod includes a longitudinal groove which facilitates cooperation with a cutting device to cut yarn when it is wound upon the rod. A yarn collection container is to be mounted on the base underneath the rod.

1 Claim, 4 Drawing Figures

YARN CUTTER

BACKGROUND OF THE INVENTION

The field of this invention relates to cutting devices and more particularly to a device which takes the yarn from a loose coil of yarn and quickly and easily cuts it into a mass of identically sized strips or lengths.

The making of hooked rugs or wall hangings has been well known for a substantial period of time. In the making of such, yarn is employed which has been previously cut into a certain length. Generally the most preferable length is three inches. Each three inch length of yarn is individually hooked into a backing material and tied with a knot.

The user can purchase directly the yarn in the precise lengths. However, the yarn in this form is three to four times more expensive than if the yarn was purchased as a skein. A skein is a loosely coiled quantity of yarn which has been wrapped upon a reel. This loose coil of yarn then must be transformed into the individual lengths of yarn. This procedure is most tedious and time consuming. Prior to this invention there was no known structure which facilitated the cutting of the skein of yarn into a mass of identical lengths.

SUMMARY OF THE INVENTION

The yarn cutter of this invention includes a planer base which is composed of two separate members which interlock together by a dovetail interlocking arrangement. Mounted on one of the base members is a holder for a skein of yarn. This holder takes the form of a plurality of, preferably four in number, upstanding arms. Each of the upstanding arms are inwardly concave and are also inherently flexible so as to facilitate the grasping of the loose coil of yarn in the supporting of such. Each of the arms are connected together through a central pivot shaft. The pivot shaft is rotatably mounted with respect to the base. On the other base member is mounted a pair of upstanding stanchions. Between the stanchions is rotatably supported a rod or spool. The rod or spool is to be rotably driven by means of a drive means such as the crank arm assembly mounted on one of the stanchions. The rod or spool includes a longitudinal groove which extends from one end of the rod to the opposite end of the rod. The yarn is to be wound on the rod in an even single layer. A knife is then to be passed along through the longitudinal groove which causes the yarn to be cut into a plurality identical in length strips. The cut strips of yarn is to be collected into a container which is to be supported upon the base beneath the rod.

DETAILED DESCRIPTION OF THE SHOWN EMBODIMENT

Figures 1, 2, 3, 4:
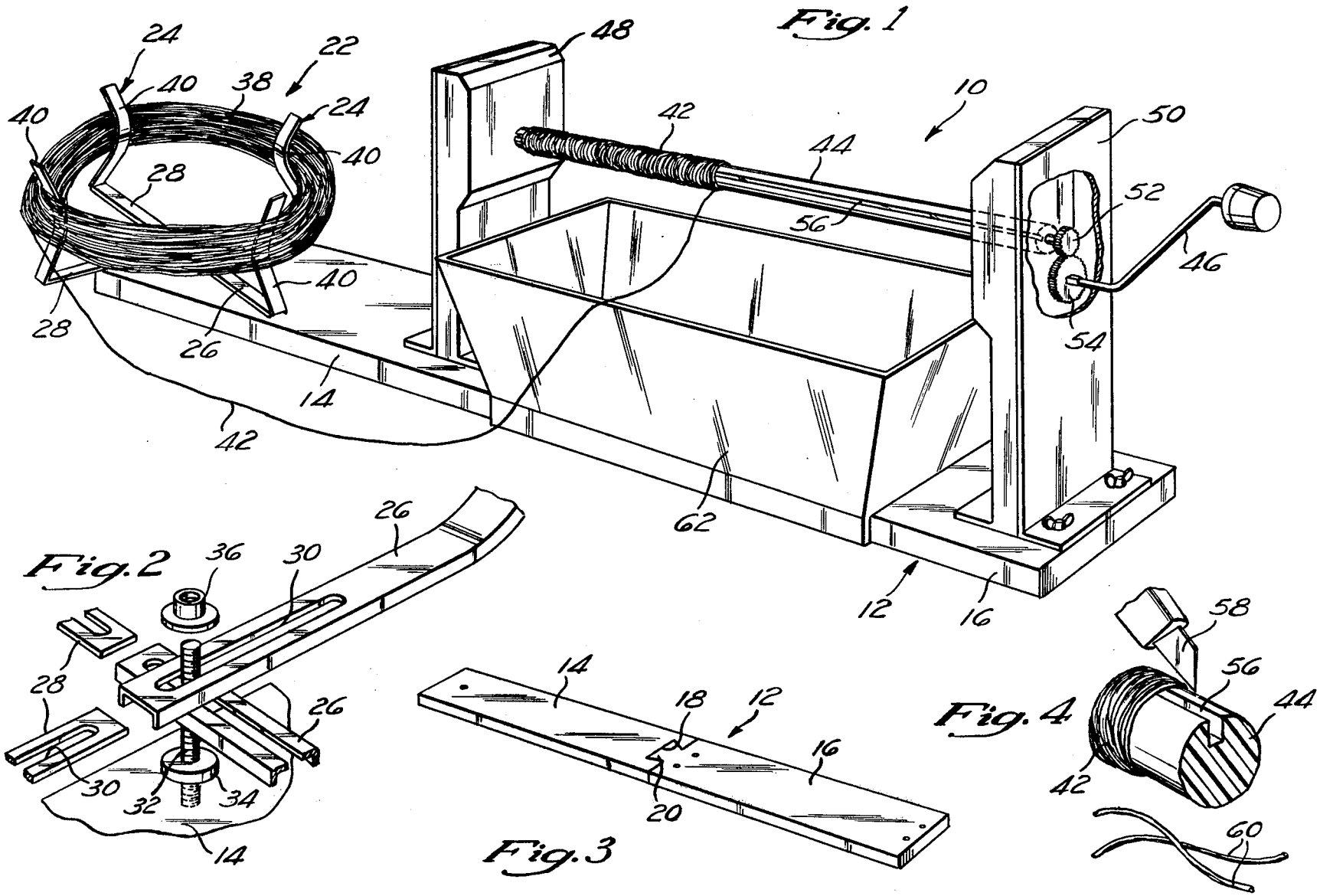
FIG. 1 is an isometric view of the yarn cutting apparatus of this invention showing the yarn being wound upon the rod prior to cutting.
FIG. 2 is a segmental isometric view of the mounting assembly for the yarn holder which is included within the apparatus of this invention.
FIG. 3 is an isometric view of the base which is employed within the apparatus of this invention.
FIG. 4 is a partial isometric view of the rod upon which the yarn is to be wound and showing its cooperation with a cutting knife.

Referring particularly to the drawing there is shown in FIG. 1 the yarn cutting apparatus 10 of this invention which includes a mounting base 12. The base 12 includes a pair of substantially equal sized sections 14 and 16. One edge of section 14 includes a dove-tail groove 18. One edge of the section 16 includes a dove-tail protuberance 20. The sections 14 and 16 can be separated to facilitate stowage of the cutter 10 of this invention. With the cutter 10 in use, the sections 14 and 16 are interlocked together by placing protuberance 20 within the groove 18.

A yarn holder 22 is to be mounted upon the section 14. This yarn holder 22 includes two pairs of arm members 24. Each pair of arm members includes first arm member 26 and second arm member 28. The horizontal section of each of the arms 26 and 28 includes a longitudinal slot 30. Also the horizontal section of each arm member 26 includes a depending flange attached at each edge thereof so as to be slightly channel shaped so as to function as a guide for the location of an arm member 28. With the arm members 26 and 28 nestled together, the slots 30 of each arm member connect.

In a similar arrangement, the other pair of arm members 24 are nestled together and located at a ninety degree angle with respect to the previous pair of arm members. As a result a pivot rod 32 can be conducted through the cooperating (four in number) slots 30. The nestled pairs of arms 24 are located between washer 34, fixed to rod 32, and the fastening nut 36 which is to be threadably secured to the free end of the pivot rod 32.

It is to be readily seen that by loosening of the nut 36, the arm members 26 and 28 can be moved with respect to the pivot rod 32. This adjustment is for the purpose of accommodating different diametered loose coils of yarn 38 within the yarn holder 22. The loose coiled yarn 38 is to be supported on the yarn holder 22 by means of four separate upstanding arms 40. There is to be an upstanding arm 40 attached to the outer end of each of the members 26 and 28. The outer surface of each of the upstanding arms 40 is concave so as to facilitate the cooperation and supporting of the coil of yarn 38. The position of each of the arms 26 and 28 is to be adjusted for the diameter of the coil 38. At this time the nut 36 is fastened tightly. The arms 40 are to be inherently constructed of a sheet material, such as sheet metal or plastic, which permits a slight bending of each of the upstanding arm members 40 in an inward direction. This slight bending is then employed in the positioning of the coil 38 in position on the arm holder 22.

The free end 42 of the coil of the arm 38 is to be wound upon the rod or spool 44. The yarn 42 is to be wound in a single even layer upon the rod 44 and this is to be accomplished by manually rotating of the rod 44 by crank arm 46 and manually manuevering the end 42 of the yarn. The rod 44 is rotatably supported between a pair of stanchions 48 and 50. Each of the stanchions 48 and 50 are fixedly mounted to the base section 16 by means of conventional fastening means. The rod 44 is idly rotatably supported within the stanchion 48. The opposite end of the rod 44 is rotatably supported with respect to the stanchion 50 and also includes a gear 52. Gear 52 connects with a drive gear 54 which is mounted on the crank arm 46. Therefore by rotation of the crank arm 46, the rod 44 is rotated.

The rod 44 includes a longitudinal groove 56. This groove 56 extends along the entire length of the rod 44. Once the single layer of yarn is wound upon the rod 44, the operator only needs to pass knife blade 58 along the groove 56 which will then cause cutting of the wound single layer of yarn into a plurality of identical in length strips or pieces of yarn 60. These pieces 60 of the yarn are to be collected by means of a collecting container 62. The collecting container 62 is mounted beneath the rod 44 on the base section 16. The collecting container 62 can be readily removed from the base section 16.

The operation of the device of this invention is believed to readily apparent. The loose coil 38 of yarn is to be placed in cooperation with each of the upstanding arms 40 after the arms 40 have been adjusted to accommodate the basic size in diameter of the coil 38. The end 42 of the yarn is to be placed in contact with the rod 44 and manually wound about the rod 42 two or three times. This begins the winding procedure and at such time the crank arm 46 can be operated which permits the yarn to be wound in an even single layer upon the rod 44.

Once the rod 44 is completely covered with yarn, the operator only need to place the knife edge 58 in the groove 56 and cut entirely along the groove 56 which in turn will cause the single layer of yarn to be transformed into a plurality of identically sized pieces 60 of yarn. These pieces will then be collected by the collecting container 62 which can subsequently be removed after completing several of the above cutting operatings.

What is claimed is:

1. An apparatus for cutting a plurality identical in length pieces of yarn comprising:

a base formed of two separate base portions;

a yarn holder mounted on one said base portion, said yarn holder being adapted to support a loosely coiled quantity of yarn, said yarn holder comprising a plurality of upstanding arms, each of said arms being angularly spaced apart, said arms being connected together upon a pivot shaft, said pivot shaft being rotatable with respect to said base, each said arm including an elongated slot, said pivot shaft extending through each said slot of each said arm, lineal movement of each said arm relative to said pivot shaft varies the location of each said arm in respect to said pivot shaft, means to fixedly secure the established position of said arms relative to said pivot shaft, each of said arms including an upstanding arm concavely shaped so that the inner surface of each of said upstanding arms forms a convex surface in respect to said pivot shaft, each of said upstanding arms being formed of a material so as to be inherently flexible in a direction towards said pivot shaft, whereby the loosely coiled quantity of yarn is adapted to be placed within the concave area of each of said upstanding arms and the locating and maintaining of such being facilitated by inherent inward flexibility of each of said upstanding arms;

a pair of spaced apart stanchions mounted on the other of said base portions;

means for detachably interlocking said base portions together;

an elongated rod terminating in a pair of ends, one of said ends being rotatably mounted on one of said stanchions, the other of said ends being rotatably mounted on the other of said stanchions, said elongated rod being spaced from said base, the exterior surface of said rod including a longitudinal groove, said longitudinal groove to facilitate cooperation with a cutting instrument to cut yarn wound about said rod;

crank means for rotating said rod to wind an even layer of yarn upon said rod, said crank means being mounted on one of said stanchions; and a collecting container mounted on said base between said pair of stanchions, whereby said collecting container is to collect said produced pieces of yarn.

* * * * *